US005201294A

United States Patent [19]

Osuka

[11] Patent Number: 5,201,294

[45] Date of Patent: Apr. 13, 1993

[54] COMMON-RAIL FUEL INJECTION SYSTEM AND RELATED METHOD

[75] Inventor: Isao Osuka, Nagoya, Japan

[73] Assignee: Nippondenso Co., Ltd., Kariya, Japan

[21] Appl. No.: 842,522

[22] Filed: Feb. 27, 1992

[30] Foreign Application Priority Data

Feb. 27, 1991 [JP] Japan ..... 3-033220

[51] Int. Cl.[5] ..... F02B 77/00

[52] U.S. Cl. ..... 123/458; 123/198 D; 123/456

[58] Field of Search ..... 123/456, 458, 479, 497, 123/359, 198 D

[56] References Cited

U.S. PATENT DOCUMENTS

| | | | |
|---|---|---|---|
| 4,469,065 | 9/1984 | Hasegawa et al. | 123/359 |
| 4,683,854 | 8/1987 | Goulet | 123/479 |
| 4,733,640 | 3/1988 | Laufer et al. | 123/479 |
| 4,777,921 | 10/1988 | Miyaki et al. | 123/456 |
| 4,793,308 | 12/1988 | Bräuninger et al. | 123/198 D |
| 4,886,028 | 12/1989 | Uchinami et al. | 123/479 |
| 4,926,829 | 5/1990 | Tuckey | 123/497 |
| 4,940,034 | 7/1990 | Heim et al. | 123/198 D |
| 4,982,331 | 1/1991 | Miyazaki | 123/497 |
| 5,058,553 | 10/1991 | Kondo et al. | 123/458 |
| 5,094,216 | 3/1992 | Miyaki et al. | 123/456 |

FOREIGN PATENT DOCUMENTS

| | | |
|---|---|---|
| 0307947 | 3/1989 | European Pat. Off. . |
| 59-32631 | 2/1984 | Japan . |
| 233449 | 2/1990 | Japan . |

*Primary Examiner*—E. Rollins Cross
*Assistant Examiner*—Thomas Moulis
*Attorney, Agent, or Firm*—Cushman, Darby & Cushman

[57] ABSTRACT

A common-rail fuel injection system for an engine includes a common rail for storing fuel. A plurality of pumps supply fuel to the common rail. Fuel is injected into the engine from the common rail. Feedback control is executed on the pressure of the fuel in the common rail. A device serves to detect whether or not at least one of the pumps fails. An arrangement decreases the pressure of the fuel in the common rail when the detecting device detects that at least one of the pumps fails.

15 Claims, 13 Drawing Sheets

FIG. 12

| | FIRST PUMP | SECOND PUMP | PRESSURE PATTERN | | |
|---|---|---|---|---|---|
| | | | PSTD | P#1 | P#2 |
| STATE 1 | NORMAL | NORMAL | A | B | C |
| STATE 2 | NORMAL | WRONG | C | D | C |
| STATE 3 | WRONG | NORMAL | B | B | D |
| STATE 4 | WRONG | WRONG | D | D | D |

COMMON-RAIL FUEL INJECTION SYSTEM AND RELATED METHOD

BACKGROUND OF THE INVENTION

1. Field of the Invention

This invention relates to a common-rail fuel injection system for an engine. This invention also relates to a method in a common-rail fuel injection system.

2. Description of the Prior Art

Common-rail fuel injection systems for diesel engines are disclosed in various documents such as Japanese published unexamined patent application 62-258160, Japanese published unexamined patent application 2-176158, European published patent application 0307947-A2, U.S. Pat. No. 4,777,921, and U.S. Pat. No. 4,940,034.

The common-rail fuel injection systems include a high pressure tubing which forms a pressure accumulator referred to as "a common rail". The fuel injection systems of this type also include high pressure fuel supply pumps for feeding high pressure fuel to the common rail, and solenoid valves for selectively allowing the high pressure fuel to flow from the common rail through injectors into engine cylinders. In general, the pressure of fuel in the common rail is controlled for accurate adjustment of the rate of the fuel injection into the engine cylinders.

The high pressure fuel supply pumps in the common-rail fuel injection system include pumping chambers, and movable plungers partially defining the pumping chambers respectively. The plungers are driven by the engine through a suitable mechanism. The drive of the plungers pressurizes fuel in the pumping chambers, forcing the fuel from the pumping chambers into the common rail. In general, spill or relief solenoid valves are connected to the pumping chambers respectively. Closing and opening the relief solenoid valves enables and disables pumping the fuel from the pumping chambers into the common rail. Thus, the rate of fuel supply to the common rail is adjusted by controlling the relief solenoid valves.

In general, the relief solenoid valves are of the normally-open type. The valve members of the relief solenoid valves are designed so that they will be urged by the pressure in the pumping chambers toward their closed positions. When a high pressure pump plunger is required to drive the fuel into the common rail, the related relief solenoid valve is energized to move its valve member to a closed position so that the fuel supply from the pumping chamber to the common rail is enabled. Then, the valve member is held in the closed position by a resulting high pressure in the pumping chamber, and the relief solenoid valve can be de-energized to save electric power. The rate of fuel supply to the common rail is adjusted by controlling the timing of energizing the relief solenoid valve, that is, the timing of closing the relief solenoid valve.

In general, the high pressure fuel supply pumps are designed so that when the relief solenoid valves are open, fuel can be fed to the pumping chambers from a low pressure side or a fuel reservoir through the relief solenoid valves. Specifically, after the fuel supply to the common rail from the pumping chamber ends, the related high pressure pump plunger moves in the direction of expanding the pumping chamber so that the pressure in the pumping chamber drops and thus the relief solenoid valve opens. It should be noted that the relief solenoid valve is de-energized a given short time after the start of the energization thereof. When the relief solenoid valve opens, fuel starts to be drawn into the pumping chamber from the low pressure side through the relief solenoid valve.

In such a prior art common-rail fuel injection system, when the energizing winding of a relief solenoid valve breaks, the relief solenoid valve remains de-energized and continues to be open. In this case, the related high pressure supply pump remains disabled, and the fuel supply from the high pressure supply pump to the common rail continues to be unexecuted. On the other hand, when a short circuit occurs so that a relief solenoid valve is continuously energized, the relief solenoid valve continues to be closed. In this case, the fuel feed to the related pumping chamber from the low pressure side remains inhibited, and thus the fuel supply from the high pressure supply pump to the common rail continues to be unexecuted. In both of the above-mentioned two cases, the continuous unexecution of the fuel supply from the high pressure pump to the common rail tends to cause some problem in the control of the pressure of fuel in the common rail. When the valve member of a relief solenoid valve mechanically sticks at its closed or open position, a similar problem occurs.

In cases where the pressure of fuel in the common rail is maintained at a given level by feedback control, such a malfunction of the relief solenoid valve of a high pressure supply pump causes a significantly great increase in the load on the other high pressure supply pump (pumps). The great increase in the load on the other high pressure supply pump is disadvantageous from the standpoint of the life thereof.

U.S. Pat. No. 4,469,065 discloses a fuel pump control system for use in an internal combustion engine having fuel injection valves each driven by a command signal indicative of a required quantity of fuel supplied to the engine. The engine is also equipped with a fuel pump which serves to supply pressurized fuel to the fuel injection valves. In the fuel pump control system of U.S. Pat. No. 4,469,065, at least one abnormality detecting means monitors the injection-valve command signal and a signal indicative of the operating state of a corresponding one of the fuel injection valves. After the levels of the two monitored signals have become out of a predetermined logical relationship, the abnormality detecting means generates an abnormality-indicative signal. The fuel pump is rendered inoperative by the abnormality-indicative signal.

SUMMARY OF THE INVENTION

It is an object of this invention to provide an improved common-rail fuel injection system for an engine.

It is another object of this invention to provide an improved method in a common-rail fuel injection system.

A first aspect of this invention provides a common-rail fuel injection system for an engine which comprises a common rail storing fuel; a plurality of pumps supplying fuel to the common rail; means for injecting fuel into the engine from the common rail; means for feedback-controlling a pressure of the fuel in the common rail; means for detecting whether or not at least one of the pumps fails; and means for decreasing the pressure of the fuel in the common rail when said detecting means detects that at least one of the pumps fails.

A second aspect of this invention provides a method in a common-rail fuel injection system for an engine which comprises a common rail storing fuel, a plurality of pumps supplying fuel to the common rail, means for injecting fuel into the engine from the common rail, and means for feedback-controlling a pressure of the fuel in the common rail, the method comprising the steps of detecting whether or not at least one of the pumps fails; and decreasing the pressure of the fuel in the common rail when said detecting step detects that at least one of the pumps fails.

BRIEF DESCRIPTION OF THE DRAWINGS

FIG. 12 is a diagram showing the relation between normal/abnormal conditions of high pressure pumps and a pattern of variations in an actual common-rail pressure.

DESCRIPTION OF THE PREFERRED EMBODIMENT

Figure 1:
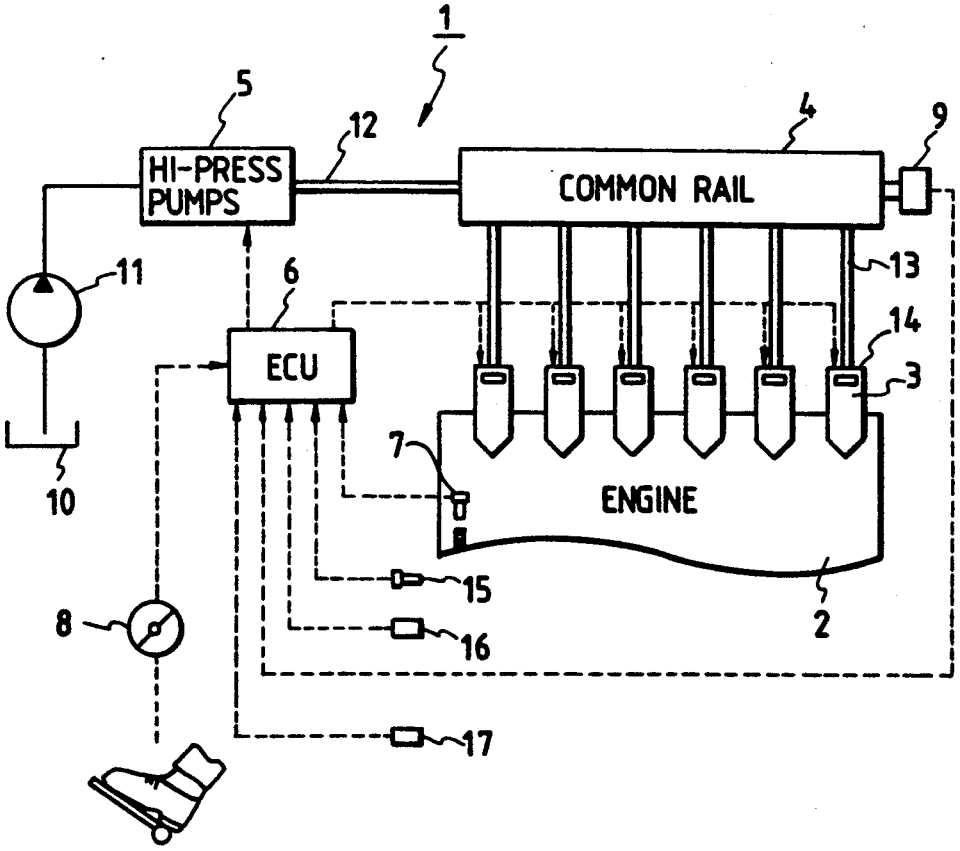
FIG. 1 is a diagram of a common-rail fuel injection system according to an embodiment of this invention.

With reference to FIG. 1, a common-rail fuel injection system 1 for a diesel engine 2 includes injectors 3 for injecting fuel into cylinders of the engine 2, a common rail 4 for storing high pressure fuel to be supplied to the fuel injectors 3, variable discharge high pressure pumps 5, and an electronic control unit (ECU) 6 for controlling the fuel injectors 3 and the variable discharge high pressure pumps 5. The number of the variable discharge high pressure pumps 5 is equal to one third of the number of cylinders of the engine 2. In the embodiment of FIG. 1, the engine 2 has six cylinders, and there are two variable discharge high pressure pumps 5.

An engine speed sensor 7 and an accelerator sensor 8 detect operating conditions of the engine 2. Specifically, the engine speed sensor 7 detects the rotational speed of the crankshaft (the output shaft) of the engine 2, that is, the engine speed. The accelerator sensor 8 detects the position of an accelerator pedal, that is, a required power output of the engine 2 (the load on the engine 2). A common-rail pressure sensor 9 detects the pressure PC in the common rail 4.

The ECU 6 is informed of the operating conditions of the engine 2 by the engine speed sensor 7 and the accelerator sensor 8, and calculates a target common-rail pressure PFIN on the basis of the operating conditions of the engine 2. The target common-rail pressure PFIN is designed so as to realize a fuel injection pressure at which the conditions of burning of fuel in the engine 2 can be optimized. The ECU 6 is also informed of the actual pressure in the common rail 4 by the common-rail pressure sensor 9. The ECU 6 controls the variable discharge high pressure pumps 5 in response to the actual pressure PC in the common rail 4 so that the actual pressure PC can be maintained at the target common-rail pressure PFIN according to feedback control.

The variable discharge high pressure pumps 5 draw fuel from a fuel tank 10 via a low fuel feed pump 11, pressurizing the fuel and pumping the pressurized fuel into the common rail 4 via fuel feed lines 12 in response to control instructions from the ECU 6.

The fuel injectors 3 are connected to the common rail 4 via fuel feed lines 13 respectively so that the fuel injectors 3 receive the fuel of a pressure essentially equal to the target common-rail pressure PFIN from the common rail 4. The fuel injectors 3 include control solenoid valves 14. The control solenoid valves 14 are opened and closed by injector control instructions from the ECU 6, periodically allowing and inhibiting the injection of the high pressure fuel into the cylinders of the engine 2 via the fuel injectors 3.

The injector control instructions are intended to adjust the fuel injection rate and the fuel injection timing. The injector control instructions are generated by the ECU 6 in response to the engine operating conditions detected by the engine speed sensor 7 and the accelerator sensor 8.

A crank angle sensor 15 detects the angular position of the crankshaft of the engine 2. A cylinder discrimination sensor 16 discriminates between the cylinders of the engine 2. An idle switch 17 mechanically connected to the accelerator pedal detects whether or not the engine 2 is idling. The ECU 6 determines timings of outputting the injector control instructions on the basis of the information detected by the crank angle sensor 15, the information detected by the cylinder discrimination sensor 16, and the information detected by the idle switch 17. In addition, the ECU 6 determines timings of outputting the control instructions to the variable discharge high pressure pumps 5 on the basis of the information detected by the crank angle sensor 15, the information detected by the idle switch 17, and the information detected by a cam angle sensor 38 (described later).

Figure 2:
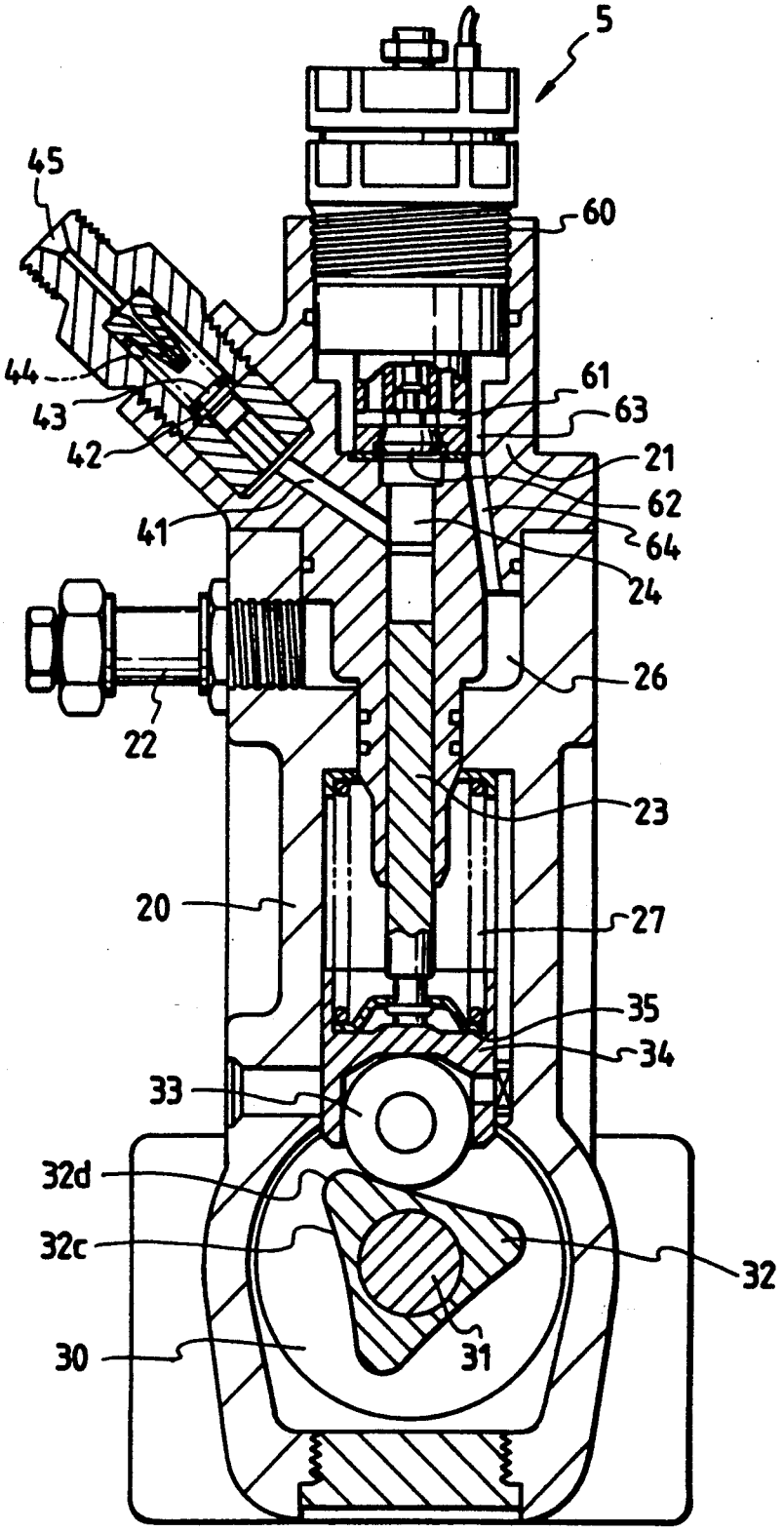
FIG. 2 is a sectional view of a variable discharge high pressure pump in FIG. 1.
Figure 3:
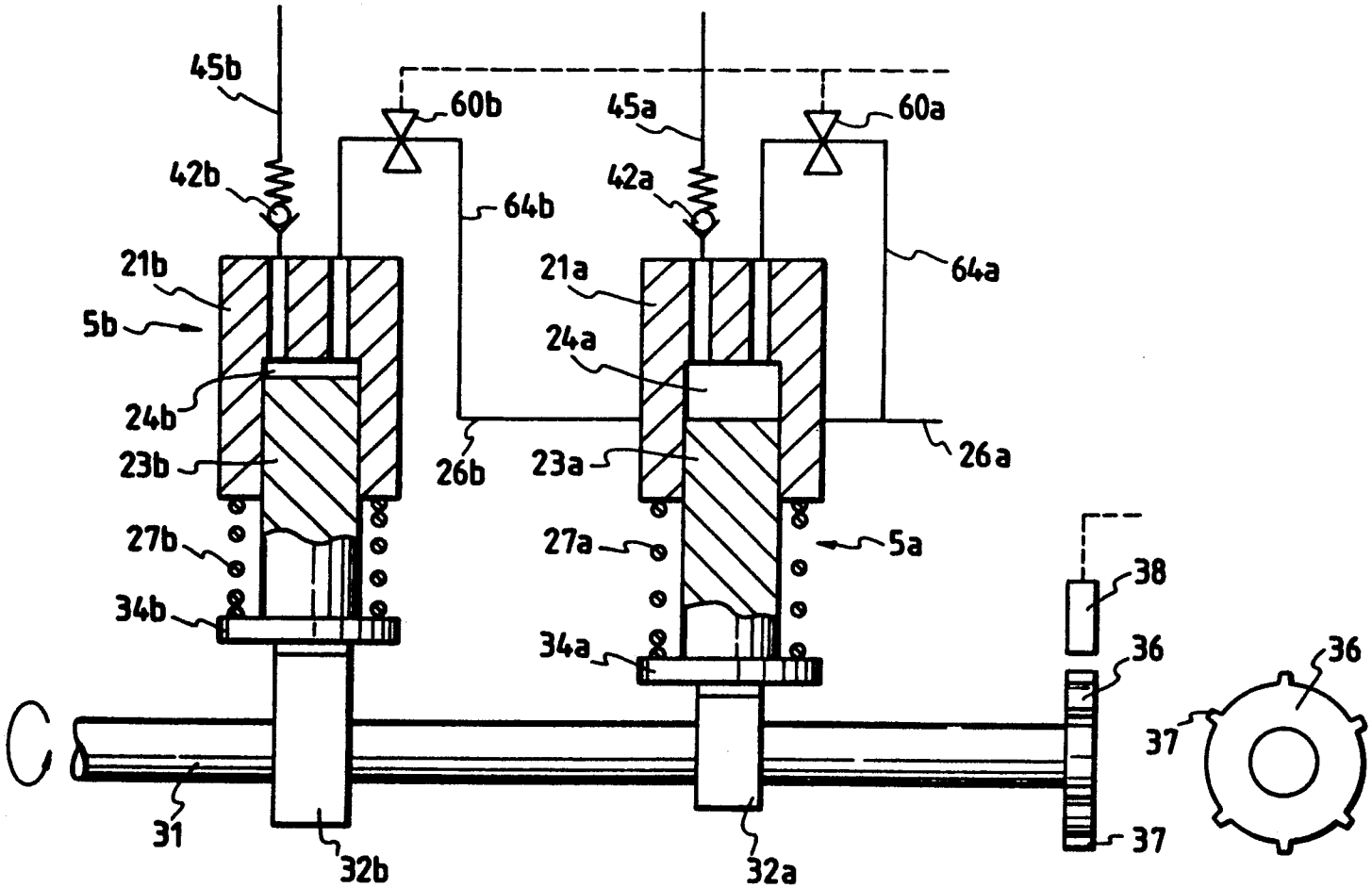
FIG. 3 is a diagram of variable discharge high pressure pumps in FIG. 1.
Figure 15:
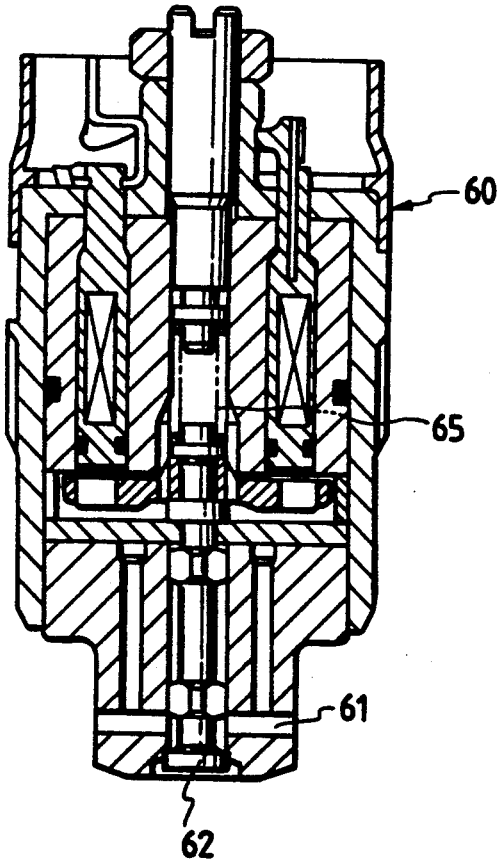
FIG. 15 is a sectional view of a part of a variable discharge high pressure pump in FIG. 1.

The variable discharge high pressure pumps 5 will now be described with reference to FIGS. 2, 3, and 15. The variable discharge high pressure pumps 5 have a common housing 20 and a common cylinder body 21.

The variable discharge high pressure pumps 5 are similar in structure, and a detailed description will be given of only one of the variable discharge high pressure pumps 5. Each variable discharge high pressure pump 5 includes a pump housing 20 formed with a cam chamber 20. The cam chamber 30 extends in a lower part of the pump housing 20. The pump housing 20 has an upper end connected to a pump cylinder 21 formed with a cylinder bore. Low pressure fuel is fed from the low pressure fuel feed pump 11 (see FIG. 1) to the variable discharge high pressure pump 5 via a fuel inlet pipe 22 connected to the pump housing 20. A solenoid valve 60 is screwed to the top of the pump cylinder 21, and is disposed in alignment with the cylinder bore.

A plunger 23 is slidably disposed in the bore of the pump cylinder 21. The plunger 23 has an upper end face which defines a pumping chamber 24 in conjunction with the inner circumferential surfaces of the pump cylinder 21 which define the cylinder bore. The pumping chamber 24 contracts and expands as the plunger 23 moves upward and downward respectively. The pump cylinder 21 has a fuel discharge port 41 which extends from the pumping chamber 24 to the fuel feed line 12 (see FIG. 1) leading to the common rail 4 (see FIG. 1).

A fuel chamber 26 is defined between the pump housing 20 and the pump cylinder 21. The low pressure fuel flows through the fuel inlet pipe 22, and then enters the fuel chamber 26. The fuel chamber 26 serves as a reservoir for receiving fuel which is spilled or returned from the pumping chamber 24.

The fuel discharge port 41 extends to an outlet 45 via a check valve 42. Fuel pressurized in the pumping chamber 24 by the upward movement of the associated plunger 23 forces a valve member 43 of the check valve 42 from its closed position against the force of a return spring 44 and the common rail pressure. When the valve member 43 of the check valve 42 separates from the closed position, the pressurized fuel flows into the common rail 4 (see FIG. 1) via the outlet 45 and the fuel feed line 12.

The lower end of the plunger 23 is connected to a spring retainer 35 which is urged by a return spring 27 against a slidable tappet 34 provided with a cam roller 33. A cam shaft 31 is accommodated in the cam chamber 30. The cam shaft 31 is coupled to the crankshaft of the engine 2 (see FIG. 1) via a suitable mechanism so that the cam shaft 31 will rotate at a speed equal to a half of the rotational speed of the engine 2. A cam 32 in contact with the cam roller 33 is mounted on the cam shaft 31. The combination of the cam 32, the cam roller 33, and the tappet 34 allows the plunger 23 to be reciprocated in the up-down direction according to the rotation of the cam shaft 31. Downward movement of the plunger 23 is enabled by the force of the return spring 27. The characteristics of movement of the plunger 23 are determined by the cam profile of the cam 32.

The bottom dead center of each plunger 23 is now defined as corresponding to a cam angle of 0 degree. The cam 32 is of approximately an equilateral triangle in cross section, having a concave surface **32*c* which extends in a cam angular range of 60 degrees and which terminates at a vertex 32*d* corresponding to the top dead center of the plunger 23**.

The solenoid valve 60 has a valve member 62 operative to block and unblock a low pressure passage 61 extending to the pumping chamber 24. The low pressure passage 61 communicates with the fuel chamber 26 via a gallery 63 and a passage 64. The solenoid valve 60 is of the normally open type. In addition, the valve member 62 is of the outwardly-open type, and is designed so that it will be urged by the pressure in the pumping chamber 24 toward its closed position. When the solenoid valve 60 is in its normal state, that is, when the solenoid valve 60 is de-energized, the valve member 62 is separated from its valve seat by the force of a spring 65 (see FIG. 15) so that the low pressure passage 61 is unblocked. When the solenoid valve 60 is energized, the valve member 62 is moved against the force of the spring 65 and is seated on its valve seat so that the low pressure passage 61 is blocked. The pressure of the fuel in the pumping chamber 24 exerts a force on the valve member 62 which urges the valve member 62 toward its closed position. Thus, the sealing characteristics of the solenoid valve 60 in the closed position increase as the fuel pressure rises.

As the plunger 23 is moved downward, the low pressure fuel is drawn into the pumping chamber 24 from the fuel chamber 26 via the solenoid valve 60. It should be noted that the solenoid valve 60 is open during the downward movement of the plunger 23. Under conditions where the solenoid valve 60 remains de-energized, that is, under conditions where the solenoid valve 60 remains open, as the plunger 23 is moved upward, the fuel is spilled or returned from the pumping chamber 24 to the fuel chamber 26 via the low pressure passage 61, the gallery 63, and the passage 64 so that pressurizing the fuel in the pumping chamber 24 is substantially absent.

During the upward movement of the plunger 23, when the solenoid valve 60 is energized so that the valve member 62 of the solenoid valve 60 blocks the low pressure passage 61, the spill or return of the fuel from the pumping chamber 24 toward the fuel chamber 26 is inhibited and thus the fuel in the pumping chamber 24 starts to be pressurized. When the fuel pressure applied to the upstream side of the valve member 43 of the check valve 42 overcomes the sum of the force of the return spring 44 and the pressure in the common rail 4 which act on the downstream side of the valve member 43, the check valve 42 is opened so that the high pressure fuel is driven from the pumping chamber 24 to the common rail 4 via the fuel discharge port 41, the outlet 45, and the fuel feed line 12 (see FIG. 1).

As described previously, the number of the variable discharge high pressure pumps 5 is equal to one third of the number of the cylinders of the engine 2. In this embodiment, there are two variable discharge high pressure pumps 5. As shown in FIG. 3, a timing gear 36 is provided on the cam shaft 31. In addition, the variable discharge high pressure pumps 5 are provided on the cam shaft 31. In FIG. 3, the two variable discharge high pressure pumps are shown as being denoted by the reference characters **5*a* and 5*b*. Members denoted by the reference numerals followed by the reference characters "a" or "b" in FIG. 3 are similar in structure to the members of FIG. 2 which are denoted by the corresponding reference numerals without being followed by the reference characters "a" or "b". Accordingly, the details of the structure of the members in FIG. 3 can be understood by referring to FIG. 2**.

The timing gear 36 has radially outward projections 37, the number of which is equal to the number of the cylinders of the engine 2. In this embodiment, there are six projections 37. The projections 37 are spaced at equal angular intervals. A cam angle sensor 38 including an electromagnetic pickup is provided radially outward of the timing gear 36. During the rotation of the timing gear 36, the cam angle sensor 38 senses the projections 37 on the timing gear 36, outputting a signal representing timings at which the plungers 23a and 23b of the variable discharge high pressure pumps 5a and 5b start to move upward, that is, timings at which the plungers 23a and 23b of the variable discharge high pressure pumps 5a and 5b reach their bottom dead centers. The output timing signal from the cam angle sensor 38 is fed to the ECU 6.

Figure 4:
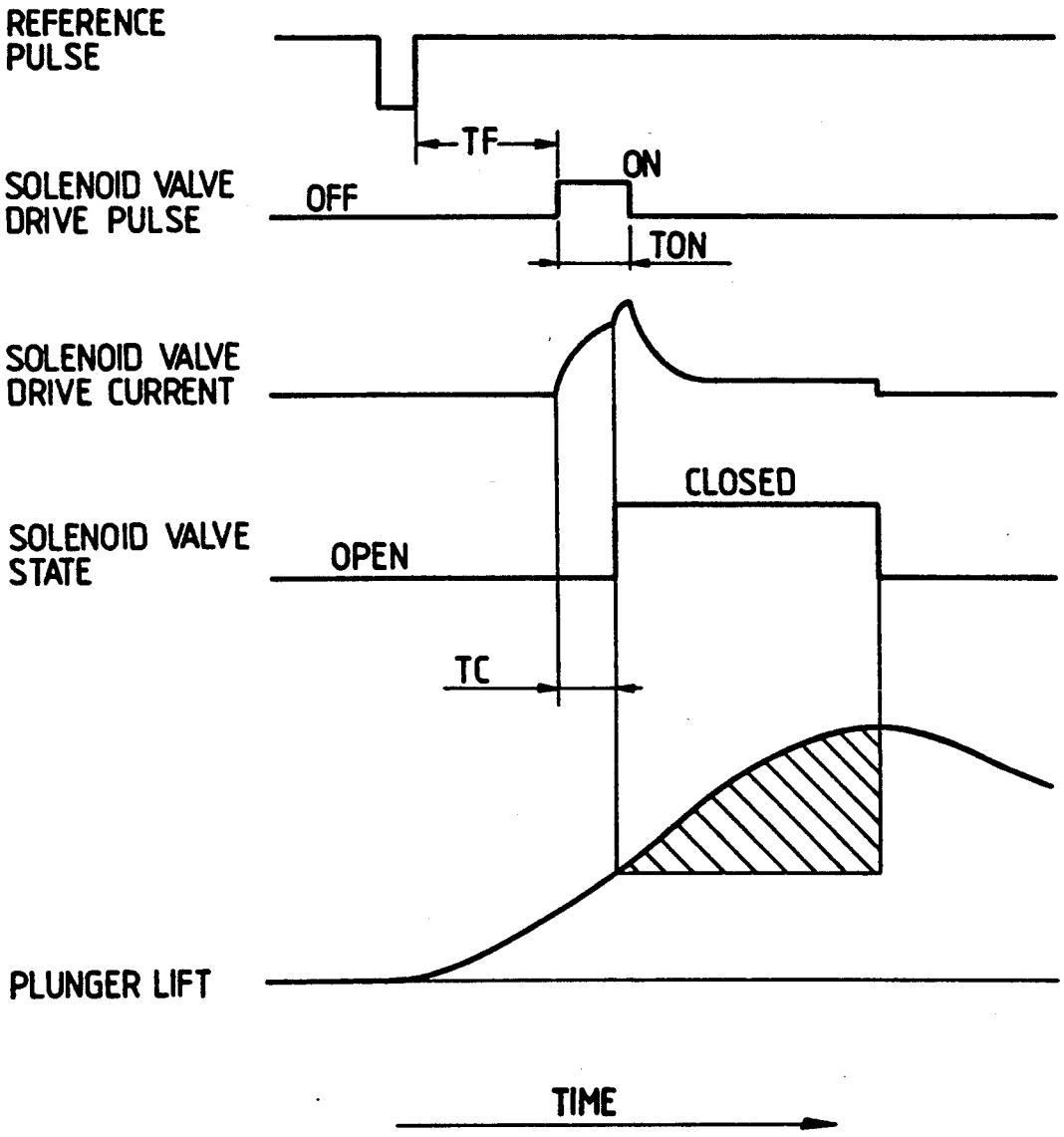
FIG. 4 is a time-domain diagram showing the waveforms of signals and a current, the changes in the state of a solenoid valve, and the variations in the lift of a plunger in respect of a variable discharge high pressure pump in FIG. 1.

The ECU 6 outputs electric drive pulses to the solenoid valves 60a and 60b in response to the timing signal fed from the cam angle sensor 38. The output timing signal from the cam angle sensor 38 includes a reference pulse (see FIG. 4) which occurs at a moment corresponding to the bottom dead center of a plunger 23 of one of the variable discharge high pressure pumps 5. As shown in FIG. 4, an electric drive pulse is outputted from the ECU 6 to a solenoid valve 60 at a moment which follows the moment of the occurrence of the reference pulse by an output wait interval TF. The solenoid valve 60 is energized by the drive pulse, being closed. As shown in FIG. 4, the rate of increases in the drive current through the solenoid valve 60 is limited, and there is a time lag (a valve closing delay) TC between the moment of the occurrence of the leading edge of the drive pulse and the moment of the occurrence of movement of the valve member 62 of the solenoid valve 60 into its closed position. Then, upward movement of the plunger 23 of a variable discharge high pressure pump 5 increases the pressure in the pumping chamber 24. The increased pressure in the pumping chamber 24 serves to hold the valve member 62 in its closed position. As shown in FIG. 4, after a given short period TON elapses since the moment of the occurrence of the leading edge of the drive pulse, the drive pulse is ended and removed to save electric power. It should be noted that the valve member 62 is held in its closed position by the increased pressure in the pumping chamber 24 after the drive pulse is removed.

The period between the moment of closing the solenoid valve 60 and a moment corresponding to the top dead center of the plunger 23 is equal to the interval of pressurizing the fuel in the pumping chamber 24. During the fuel pressurizing interval, the amount of fuel which is proportional to the area of the hatched part of FIG. 4 is pumped from the pumping chamber 23 toward the common rail 4. As the timing of outputting the drive pulse is earlier, a large amount of fuel is pumped to the common rail 4. As the timing of outputting the drive pulse is retarded, a smaller amount of fuel is pumped to the common rail 4. Thus, the pressure in the common rail 4 can be adjusted in accordance with the timing of outputting the drive pulse, that is, in accordance with the output wait time TF.

Figure 5:
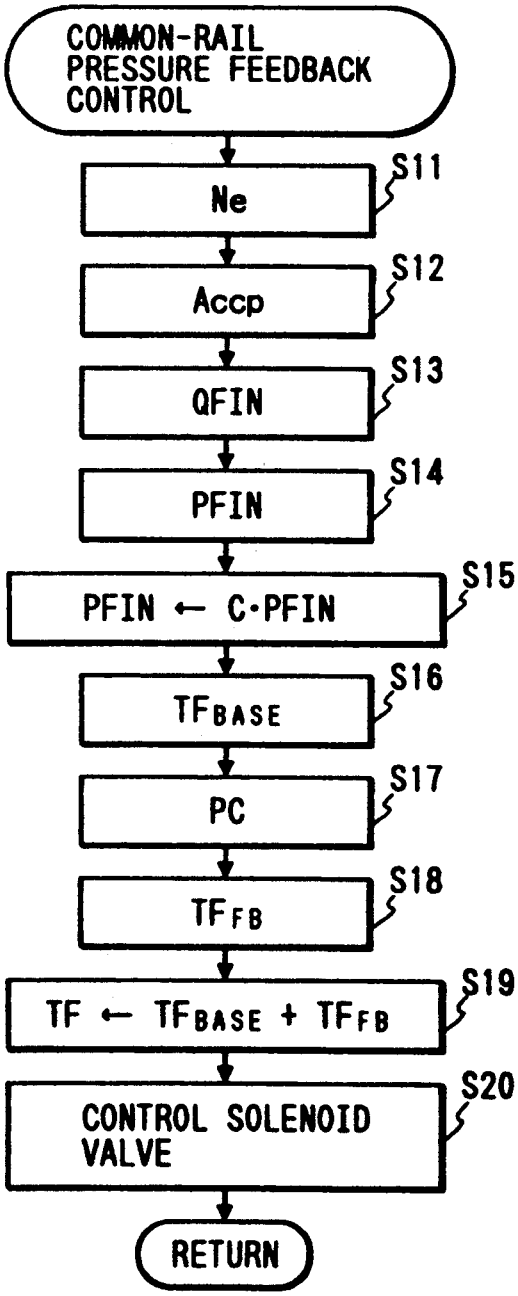
FIG. 5 is a flowchart of a common-rail pressure feedback control section of a program for controlling the ECU in FIG. 1.

The ECU 6 includes a microcomputer having a combination of a CPU, a ROM, a RAM, and an I/O port. The ECU 6 operates in accordance with a program stored in the ROM. The program has a section corresponding to common-rail pressure feedback control. The common-rail pressure feedback control section of the program is periodically reiterated. FIG. 5 is a flowchart of the common-rail pressure feedback control section of the program.

As shown in FIG. 5, the common-rail pressure feedback control section of the program starts at a step S11 which calculates the current engine speed Ne on the basis of the output signal from the engine speed sensor 7. A step S12 following the step S11 executes the analog-to-digital conversion of the output signal from the accelerator sensor 8, and derives the current degree Accp of depression of the accelerator pedal. Specifically, the I/O port within the ECU 6 includes an analog-to-digital converter processing the output signal from the accelerator sensor 8, and the step S12 executes the analog-to-digital conversion by using this analog-to-digital converter. The current accelerator depression degree Accp is represented by a percentage (%) with respect to the maximum accelerator depression degree.

Figure 6:
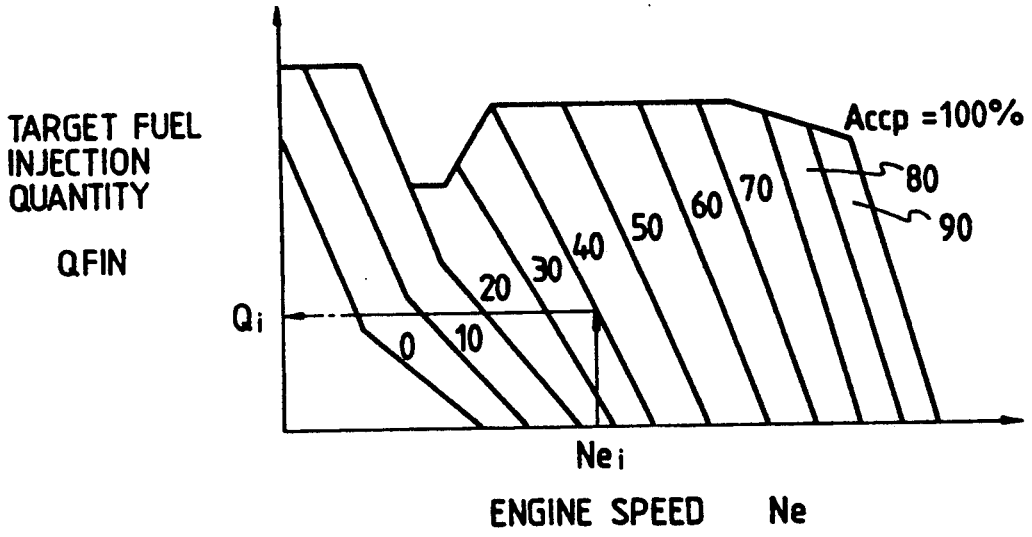
FIG. 6 is a diagram showing a map for calculating a target fuel injection quantity.

A step S13 following the step S12 determines a target fuel injection quantity QFIN on the basis of the current engine speed Ne and the current accelerator depression degree Accp. Specifically, the ROM within the ECU 6 holds a map such as shown in FIG. 6 where values of the target fuel injection quantity are plotted as a function of the engine speed and the accelerator depression degree. The target fuel injection quantity QFIN is determined by referring to the map of FIG. 6. The step S13 stores the determined target fuel injection quantity QFIN into the RAM within the ECU 6.

Figure 7:
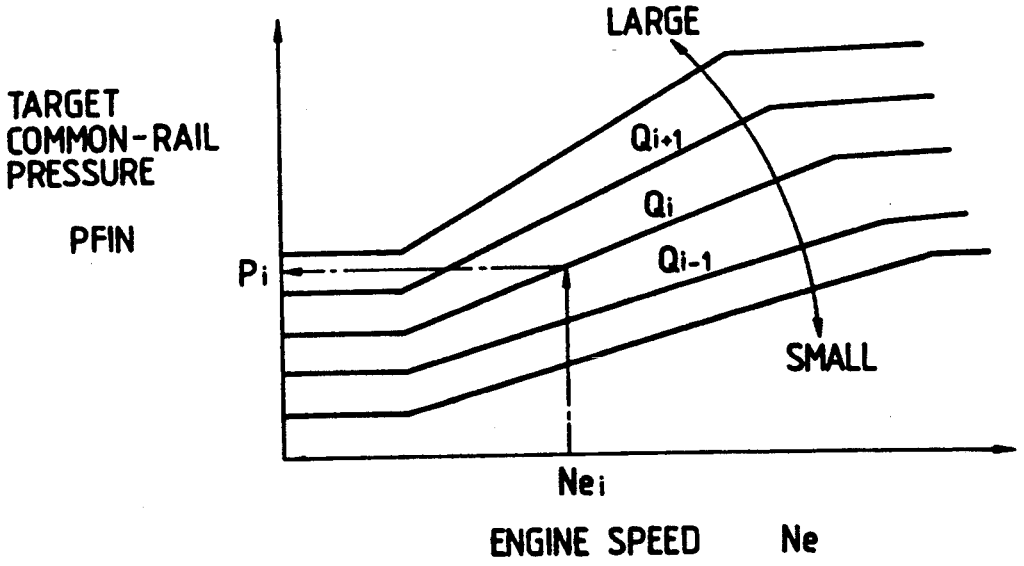
FIG. 7 is a diagram showing a map for calculating a target common-rail pressure.

A step S14 following the step S13 determines a target common-rail pressure PFIN on the basis of the current engine speed Ne and the current accelerator depression degree Accp. Specifically, the ROM within the ECU 6 holds a map such as shown in FIG. 7 where values of the target common-rail pressure are plotted as a function of the engine speed and the accelerator depression degree. The target common-rail pressure PFIN is determined by referring to the map of FIG. 7. The step S14 stores the determined target common-rail pressure PFIN into the RAM within the ECU 6.

A step S15 following the step S14 multiplies the current target common-rail pressure by a corrective coefficient C, and sets the resultant of the multiplication as a new target common-rail pressure PFIN. Specifically, the step S15 executes the program statement "PFIN=C·PFIN". As will be made clear later, the corrective coefficient C can be changed between predetermined larger and smaller values. For example, the larger value is equal to 1.0, and the smaller value is equal to a suitable value smaller than 1.0 but larger than 0.0. When the corrective coefficient C is equal to the larger value, that is, 1.0, the step S15 does not correct the target common-rail pressure PFIN. When the corrective coefficient C is equal to the smaller value, the step S15 decreases the target common-rail pressure PFIN.

Figure 8:
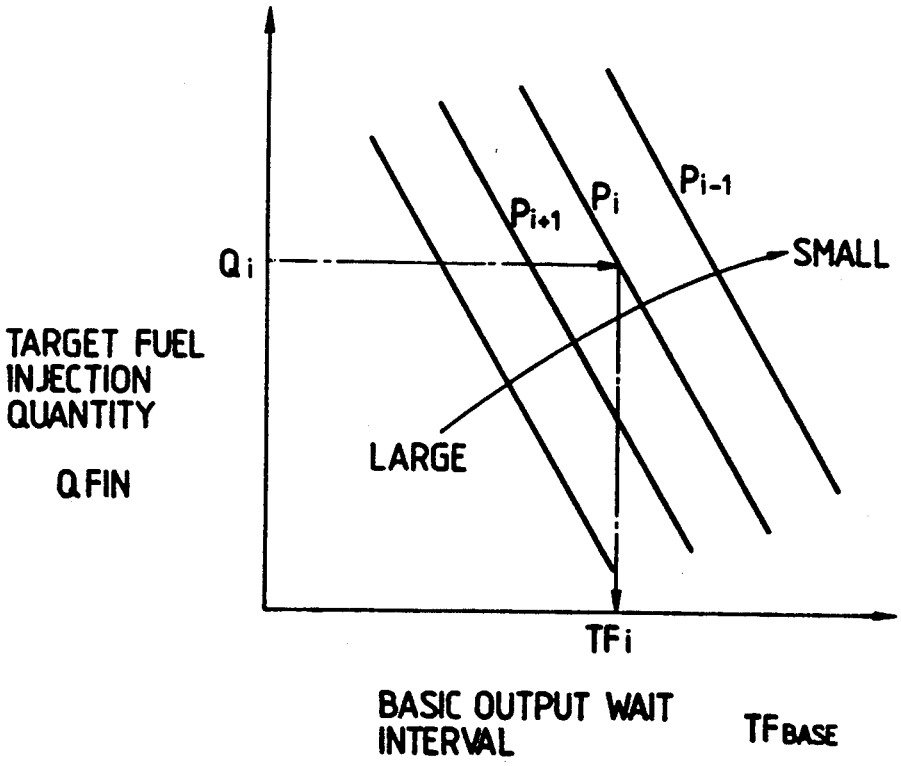
FIG. 8 is a diagram showing a map for calculating a reference output wait interval.

A step S16 following the step S15 determines a basic value TFBASE of a drive-pulse wait intervals (a basic output wait interval TFBASE) on the basis of the target common-rail pressure PFIN and the target fuel injection quantity QFIN. Specifically, the ROM within the ECU 6 holds a map such as shown in FIG. 8 where values of the basic output wait interval are plotted as a function of the target common-rail pressure and the target fuel injection quantity. The basic output wait interval TFBASE is determined by referring to the map of FIG. 8.

A step S17 following the step S16 executes the analog-to-digital conversion of the output signal from the common-rail pressure sensor 9, and derives the actual common-rail pressure PC. Specifically, the I/O port within the ECU 6 includes an analog-to-digital converter processing the output signal from the common-rail pressure sensor 9, and the step S17 executes the analog-to-digital conversion by using this analog-to-digital converter.

A step S18 following the step S17 calculates the difference ΔP between the actual common-rail pressure PC and the target common-rail pressure PFIN by referring to the equation "ΔP=PC−PFIN". The step S18 calculates a corrective value TFFB on the basis of the pressure difference ΔP. The corrective value TFFB is designed so as to correct the basic output wait interval TFBASE. The calculation of the corrective value TFFB is done according to a PID-control scheme.

A step S19 following the step S18 calculates a final output wait interval TF from the basic output wait interval TFBASE and the corrective value TFFB by referring to the equation "TF=TFBASE+TFFB".

A step S20 following the step S19 controls the solenoid valves 60*a* and 60*b* in accordance with the final output wait interval TF. This control of the solenoid valves 60*a* and 60*b* is designed so that the actual common-rail pressure can be maintained essentially at the target common-rail pressure PFIN which enables suitable fuel injection into the engine cylinders in response to the engine speed Ne and the accelerator depression degree Accp. After the step S20, the current execution cycle of the common-rail pressure feedback control section of the program ends, and the program returns to a main routine.

Figure 9:
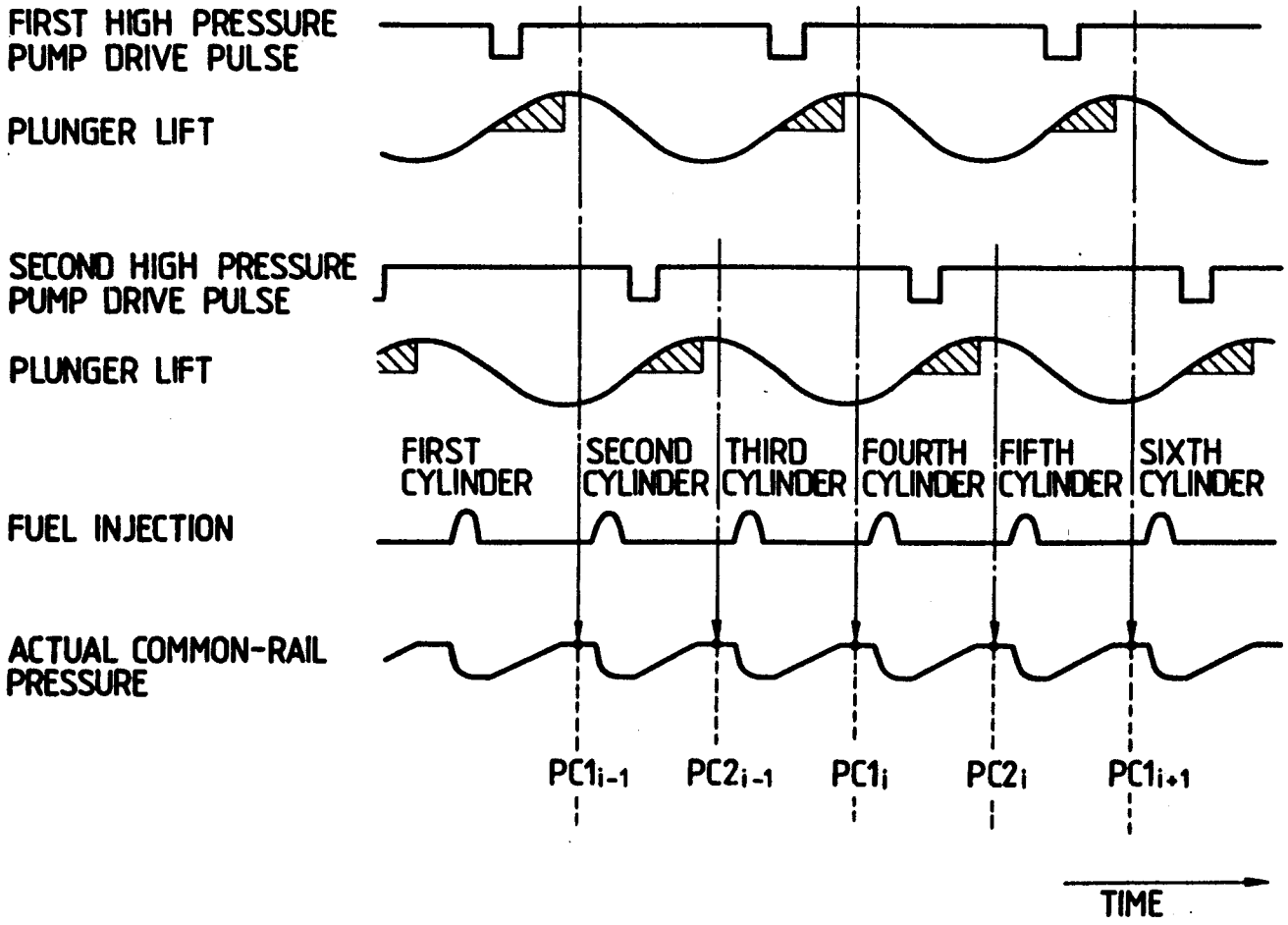
FIG. 9 is a time-domain diagram showing the relation among operations of high pressure pumps, an actual common-rail pressure, and fuel injection into an engine in the common-rail fuel injection system of FIG. 1.
Figure 10:
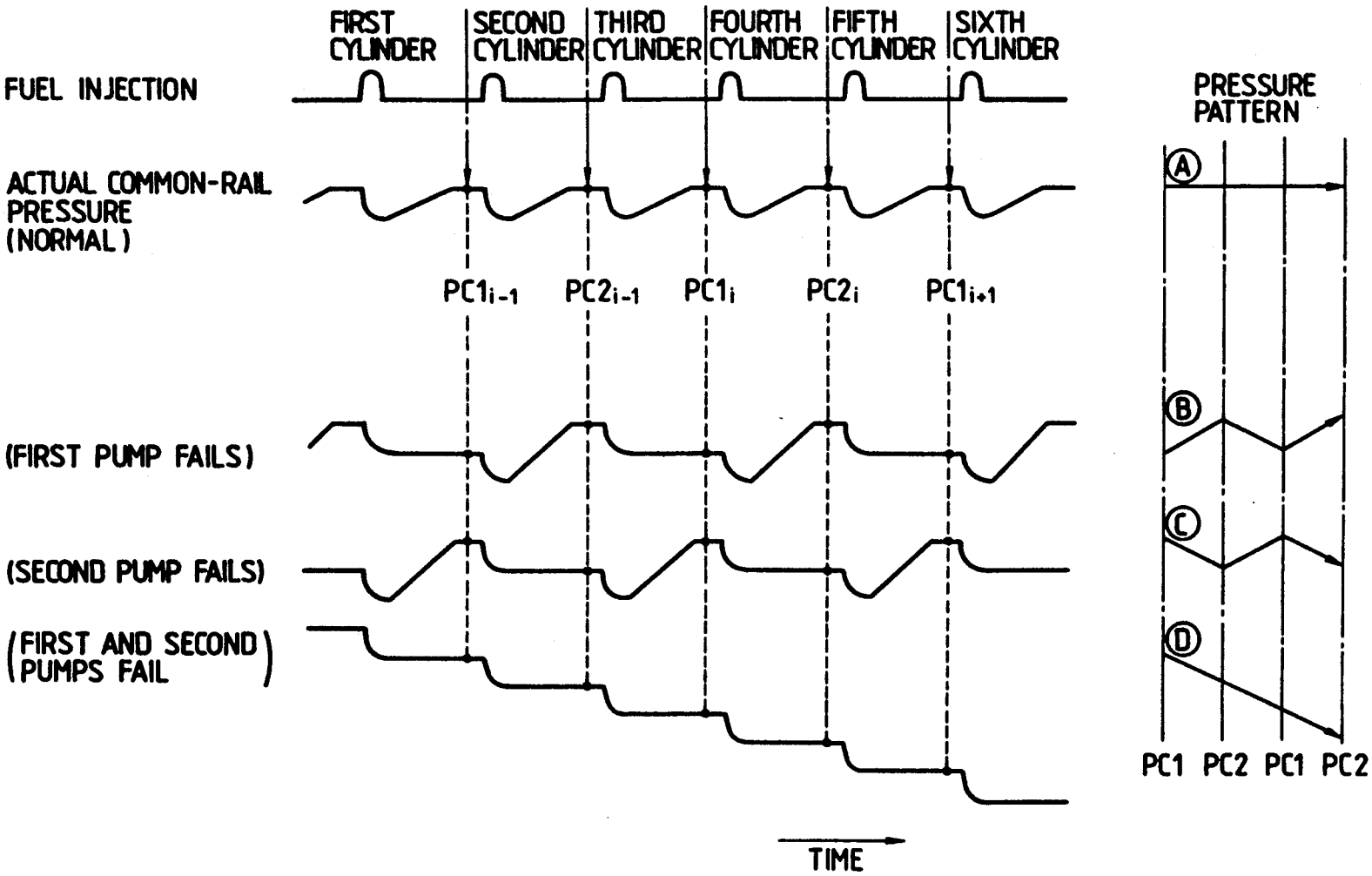
FIG. 10 is a time-domain diagram showing variations in an actual common-rail pressure under normal and abnormal conditions, patterns of variations in the actual common-rail pressure, and fuel injection timings.

As shown in FIGS. 9 and 10, the actual pressure PC of fuel in the common rail 4 periodically fluctuates around the target common-rail pressure PFIN in response to the fuel injection from the common rail 4 into the engine cylinders, and in response to the fuel supply to the common rail 4 from the high pressure pumps 5*a* and 5*b*. Specifically, the fuel injection from the common rail 4 into the engine cylinders decreases the actual common-rail pressure PC. On the other hand, the fuel supply to the common rail 4 from the high pressure pumps 5*a* and 5*b* increases the actual common-rail pressure PC. From the standpoint of time average, the actual common-rail pressure PC is maintained at the target common-rail pressure PFIN. In FIG. 10, a pattern of variations in the actual common-rail pressure PC which occurs under normal conditions is diagrammatically represented by the straight-line waveform A.

When the electric power feed line to a solenoid valve 60 or the energizing winding of the solenoid valve 60 breaks, or when the valve member 62 of the solenoid valve 60 sticks, the related high pressure pump 5 is disabled so that the high pressure pump 5 fails to supply fuel to the common rail 4.

It is now assumed that such a trouble or malfunction occurs in the high pressure pump 5*a*. In this case, the actual common-rail pressure remains unchanged during the fuel supply period related to the high pressure pump 5*a*, and increases during the fuel supply period related to the high pressure pump 5*b* as denoted by the curve W1 of FIG. 10. In addition, a pattern of variations in the actual common-rail pressure PC which occurs under these abnormal conditions is diagrammatically represented by the waveform B.

It is now assumed that a similar trouble or malfunction occurs in the high pressure pump 5*b*. In this case, the actual common-rail pressure remains unchanged during the fuel supply period related to the high pressure pump 5*b*, and increases during the fuel supply period related to the high pressure pump 5*a* as denoted by the curve W2 of FIG. 10. In addition, a pattern of variations in the actual common-rail pressure PC which occurs under these abnormal conditions is diagrammatically represented by the waveform C.

It is now assumed that similar troubles or malfunctions occur in both the high pressure pumps 5*a* and 5*b*. In this case, the actual common-rail pressure continues to drop as denoted by the curve W3 of FIG. 10. In addition, a pattern of variations in the actual common-rail pressure PC which occurs under these abnormal conditions is diagrammatically represented by the waveform D.

In a prior art common-rail fuel injection system using common-rail pressure feedback control, when one of two high pressure pumps fails to supply fuel to a common rail, the other high pressure pump is forced to supply fuel to the common rail at a significantly high rate. In other words, the load on the other high pressure pump (the normal high pressure pump) becomes significantly great. The great increase in the load on the other pump (the normal pump) is disadvantageous from the standpoint of the life thereof. As will be made clear later, the embodiment of this invention is free from such a disadvantage.

Figure 11:
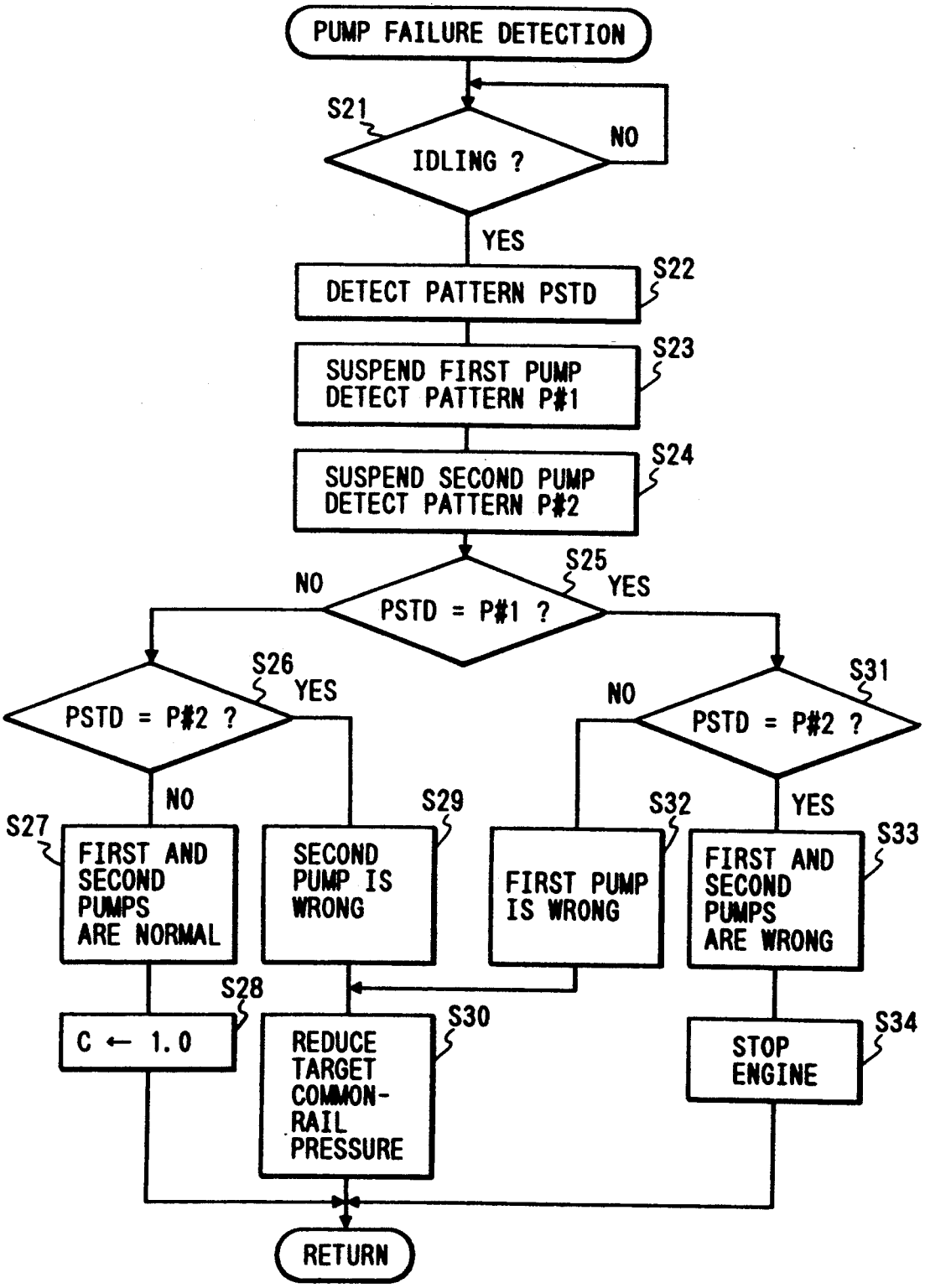
FIG. 11 is a flowchart of a pump-abnormality detecting section of the program controlling the ECU in FIG. 1.

The program for controlling the ECU 6 has a pump-abnormality (pump-failure) detecting section which is periodically reiterated. FIG. 11 is a flowchart of the pump-abnormality (pump-failure) detecting section of the program.

As shown in FIG. 11, the pump-abnormality detecting section of the program starts at a step S21 which decides whether or not the engine 2 is currently in stable idling conditions by referring to the output signals from the idle switch 17 and the engine speed sensor 7. When the engine 2 is currently in stable idling conditions, the program advances to a step S22. When the engine 2 is not currently in stable idling conditions, the program moves out of the step S21 and then reenters the step S21. When the engine 2 is not currently in stable idling conditions, the program may return to the main routine.

The step S22 detects the pattern of variations in the actual common-rail pressure during a given time by monitoring and tracing the output signal from the common-rail pressure sensor 9. The detected pattern of variations in the actual common-rail pressure is defined as a reference pressure pattern PSTD.

A step S23 following the step S22 forcedly suspends the operation of the first high pressure pump 5*a* by, for example, keeping the related solenoid valve 60*a* de-energized for a given time. During the suspension of the first high pressure pump 5*a*, the step S23 detects the pattern of variations in the actual common-rail pressure by monitoring and tracing the output signal from the common-rail pressure sensor 9. The detected pattern of variations in the actual common-rail pressure is defined as a first suspension pressure pattern P#1.

As step S24 following the step S23 forcedly suspends the operation of the second high pressure pump 5*b* by, for example, keeping the related solenoid valve 60*b* de-energized for a given time. During the suspension of the second high pressure pump 5*b*, the step S24 detects the pattern of variations in the actual common-rail pressure by monitoring and tracing the output signal from the common-rail pressure sensor 9. The detected pattern of variations in the actual common-rail pressure is defined as a second suspension pressure pattern P#2.

A step S25 following the step S24 decides whether or not the reference pressure pattern PSTD and the first suspension pressure pattern P#1 essentially match with each other. When the reference pressure pattern PSTD and the first suspension pressure pattern P#1 essentially match with each other, the program advances to a step S31. Otherwise, the program advances to a step S26.

The step S26 decides whether or not the reference pressure pattern PSTD and the second suspension pressure pattern P#2 essentially match with each other. When the reference pressure pattern PSTD and the second suspension pressure pattern P#1 essentially match with each other, the program advances to a step S29. Otherwise, the program advances to a step S27.

The step S27 decides both the high pressure pumps 5*a* and 5*b* to be normal, and a step S28 following the step S27 sets the target common-rail pressure corrective coefficient C to 1.0. The target common-rail pressure corrective coefficient C is used in the step S15 of FIG. 5. When the target common-rail pressure corrective coefficient C is equal to 1.0, the step S15 does not correct the target common-rail pressure PFIN. After the step S28, the current execution cycle of the pump-abnormality detecting section of the program ends and the program returns to the main routine.

The step S29 decides the first high pressure pump 5*a* and the second high pressure pump 5*b* to be normal and abnormal respectively, and then the program advances to a step S30 which sets the target common-rail pressure corrective coefficient C to a predetermined value smaller than 1.0 but larger than 0.0. The target common-rail pressure corrective coefficient C is used in the step S15 of FIG. 5. When the target common-rail pressure corrective coefficient C is smaller than 1.0, the step S15 decreases the target common-rail pressure PFIN as compared with that in normal cases. After the step S30, the current execution cycle of the pump-abnormality detecting section of the program ends and the program returns to the main routine.

The step S31 decides whether or not the reference pressure pattern PSTD and the second suspension pressure pattern P#2 essentially match with each other. When the reference pressure pattern PSTD and the second suspension pressure pattern P#1 essentially match with each other, the program advances to a step S33. Otherwise, the program advances to a step S32.

The step S32 decides the first high pressure pump 5*a* and the second high pressure pump 5*b* to be abnormal and normal respectively, and then the program advances to the step S30. Thus, in this case, the target common-rail pressure corrective coefficient C is set to the predetermined value smaller than 1.0 but larger than 0.0, and the target common-rail pressure PFIN is decreased by the step S15 of FIG. 5 as compared with that in normal cases.

The step S33 decides both the high pressure pumps 5*a* and 5*b* to be abnormal, and a step S34 following the step S33 suspends the operation of the engine 2. It should be noted that the step S34 may be omitted for the following reason. In cases where both the high pressure pumps 5*a* and 5*b* are abnormal, the actual common-rail pressure generally drops to a very low level so that the fuel supply to the cylinders of the engine 2 halts and the engine 2 stops naturally. After the step S34, the current execution cycle of the pump-abnormality detecting section of the program ends and the program returns to the main routine.

As understood from the previous description, in the case where both the high pressure pumps 5*a* and 5*b* are normal, the step S15 of FIG. 5 does not correct the target common-rail pressure PFIN so that the actual common-rail pressure PC will be controlled at the non-corrected target common-rail pressure PFIN. In the case where one of the high pressure pumps 5*a* and 5*b* is normal but the other is abnormal, the step S15 of FIG. 5 decreases the target common-rail pressure PFIN as compared with that in normal cases so that the actual common-rail pressure PC will be controlled at the decreased target common-rail pressure PFIN. In other words, when one of the high pressure pumps 5*a* and 5*b* fails, the target common-rail pressure is decreased. This decrease in the target common-rail pressure prevents an excessive increase in the load on the normal high pressure pump (different from the wrong high pressure pump), so that a problem regarding the life thereof can be removed. In the case where both the high pressure pumps 5*a* and 5*b* are abnormal, the step S34 of FIG. 11 stops the engine 2.

The design of the detection of failures of the high pressure pumps 5*a* and 5*b* is based on the following facts. As shown in FIG. 12, in the case where both the first and second high pressure pumps 5*a* and 5*b* are normal, the reference pressure pattern PSTD agrees with the waveform A while the first and second suspension pressure patterns P#1 and P#2 correspond to the waveforms B and C respectively. Thus, when either of the first and second high pressure pumps 5*a* and 5*b* is suspended, the pattern of variations in the actual common-rail pressure deviates or changes from the waveform A. This pattern change can be used in the detection of normal operation of the high pressure pumps 5*a* and 5*b*.

As shown in FIG. 12, in the case where the first and second high pressure pumps 5*a* and 5*b* are normal and abnormal respectively, the reference pressure pattern PSTD agrees with the waveform C while the first and second suspension pressure patterns P#1 and P#2 correspond to the waveforms D and C respectively. Thus, when the second high pressure pump 5*b* is suspended, there occurs no change in the pattern of variations in the actual common-rail pressure. It should be noted that the second high pressure pump 5*b* is abnormal. This pattern constancy can be used in the detection of a failure of the second high pressure pump 5*b*.

As shown in FIG. 12, in the case where the first and second high pressure pumps 5*a* and 5*b* are abnormal and normal respectively, the reference pressure pattern PSTD agrees with the waveform B while the first and second suspension pressure patterns P#1 and P#2 correspond to the waveforms B and D respectively. Thus, when the first high pressure pump 5*a* is suspended, there occurs no change in the pattern of variations in the actual common-rail pressure. It should be noted that the first high pressure pump 5*a* is abnormal. This pattern constancy can be used in the detection of a failure of the first high pressure pump 5*a*.

As shown in FIG. 12, in the case where both the first and second high pressure pumps 5*a* and 5*b* are abnormal, the reference pressure pattern PSTD agrees with the waveform D while the first and second suspension pressure patterns P#1 and P#2 also correspond to the waveform D. Thus, when either of the first and second high pressure pumps 5*a* and 5*b* is suspended, there occurs no change in the pattern of variations in the actual common-rail pressure. It should be noted that both the first and second high pressure pump 5*a* and 5*b* are abnormal. This pattern constancy can be used in the direction of failures of the first and second high pressure pumps 5*a* and 5*b*.

Under stable idling conditions of the engine 2, the intrinsic characteristics of the waveforms A, B, C, and D can appear clearly, and the discrimination between the waveforms A, B, C, and D is easy so that failures of the first and second high pressure pumps 5*a* and 5*b* can be detected accurately. Under engine operating conditions other than stable engine idling conditions, the intrinsic characteristics of the waveforms A, B, C, and D tend to be hidden by noise components, and the discrimination between the waveforms A, B, C, and D is sometimes difficult. Accordingly, it is desirable to execute the pump-failure detecting process during stable engine idling conditions.

It should be noted that the embodiment of this invention may be modified in various ways as indicated hereinafter. In a first modification of the embodiment, when a failure of one of the high pressure pumps 5*a* and 5*b* is detected, the step S30 of FIG. 11 sets the target common-rail pressure corrective coefficient C to O in order to reduce the target common-rail pressure PFIN to a null level or an unpressurized level. This reduction in the target common-rail pressure PFIN reliably prevents a damage to the normal high pressure pump.

Figure 13:
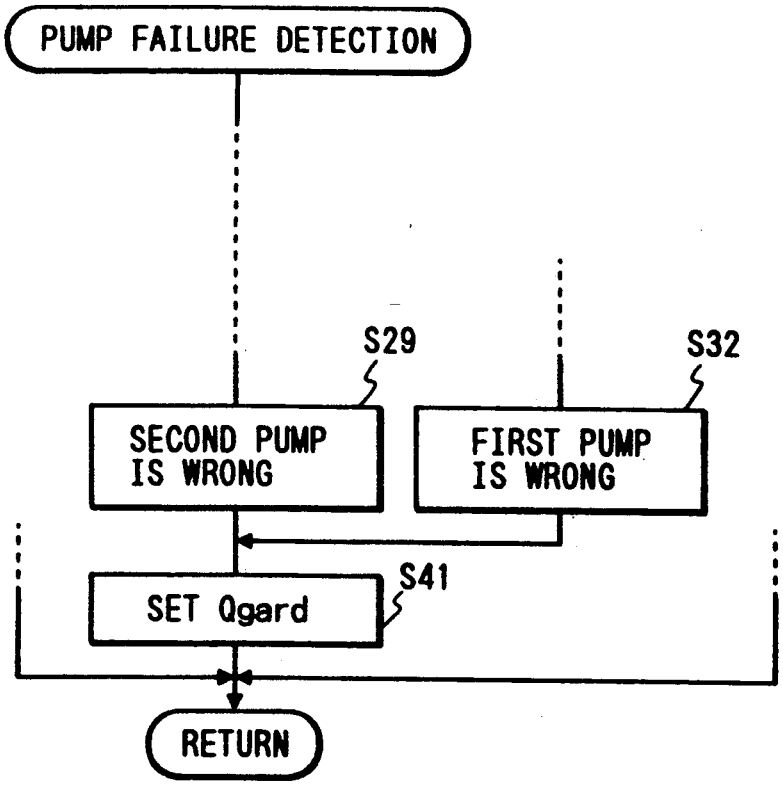
FIG. 13 is a flowchart of a pump-abnormality detecting section of a program controlling an ECU in a modified embodiment of this invention.
Figure 14:
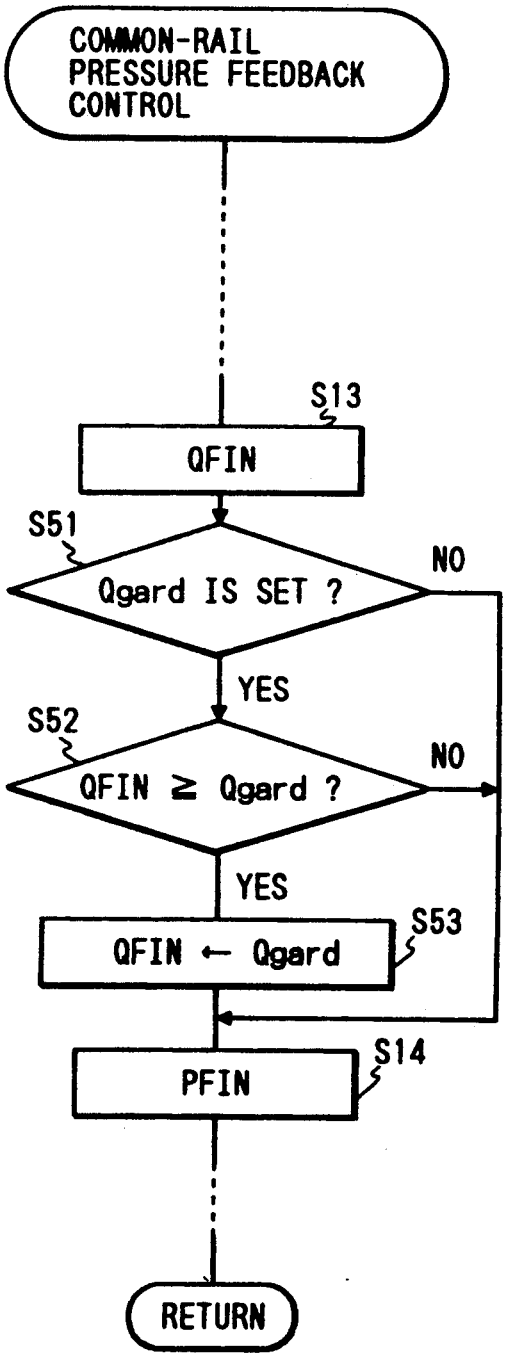
FIG. 14 is a flowchart of a common-rail pressure feedback control section of the program controlling the ECU in the modified embodiment.

As shown in FIG. 13, a second modification of the embodiment includes a step S41 in place of the step S30 of FIG. 11. The step S41 sets a preset guard value Qgard for the target fuel injection quantity QFIN. As shown in FIG. 14, the second modification further includes steps S51, S52, and S53 between the steps S13 and S14 of FIG. 5. The step S51 which follows the step S13 decides whether or not the guard value Qgard is set. When the guard value Qgard is decided to be set, the program advances to the step S52. Otherwise, the program jumps to the step S14. The step S52 compares the target fuel injection quantity QFIN and the guard value Qgard. When the target fuel injection quantity QFIN is equal to or greater than the guard value Qgard, the program advances to the step S53. When the target fuel injection quantity QFIN is smaller than the guard value Qgard, the program jumps to the step S14. The step S53 sets the target fuel injection quantity QFIN equal to the guard value Qgard in order to limit the target fuel injection quantity QFIN within a range equal to or below the guard value Qgard. After the step S53, the program advances to the step S14. In the second modification, when one of the high pressure pumps 5*a* and 5*b* fails, the target fuel injection quantity QFIN is limited within the range equal to below the guard value Qgard. This limitation on the target fuel injection quantity QFIN causes a limitation on the target common-rail pressure PFIN, so that an excessive increase in the load on the normal high pressure pump can be prevented.

A third modification of the embodiment is similar to the second modification except that the third modification includes the step S30 of FIG. 11.

What is claimed is:

1. A common-rail fuel injection system for an engine, comprising:

a common rail storing fuel;

a plurality of pumps supplying fuel to the common rail;

means for injecting fuel into the engine from the common rail;

means for feedback-controlling a pressure of the fuel in the common rail;

means for detecting whether or not at least one of the pumps fails; and means for decreasing the pressure of the fuel in the common rail when said detecting means detects that at least one of the pumps fails.

2. The common-rail fuel injection system of claim 1, wherein said detecting means comprises means for detecting the pressure of the fuel in the common rail, and means for detecting whether or not at least one of the pumps fails in response to the detected pressure of the fuel in the common rail.

3. The common-rail fuel injection system of claim 1, wherein said feedback-controlling means maintains the pressure of the fuel in the common rail at a target pressure, and said decreasing means comprises means for decreasing the target pressure when said detecting means detects that at least one of the pumps fails.

4. The common-rail fuel injection system of claim 1, wherein said detecting means comprises means for changing operating conditions of one of the pumps, means for detecting a response of the pressure of the fuel in the common rail to said changing of operating conditions of one of the pumps by said changing means, and means for detecting whether or not at least one of the pumps fails on the basis of the detected response of the pressure of the fuel in the common rail.

5. The common-rail fuel injection system of claim 1, wherein said detecting means comprises idle detecting means for detecting whether or not the engine is idling, means for changing operating conditions of one of the pumps when said idle detecting means detects that the engine is idling, means for detecting a response of the pressure of the fuel in the common rail to said changing of operating conditions of one of the pumps by said changing means, and means for detecting whether or not at least one of the pumps fails on the basis of the detected response of the pressure of the fuel in the common rail.

6. The common-rail fuel injection system of claim 1, wherein said detecting means comprises means for selectively suspending one of the pumps, means for detecting the pressure in the fuel in the common rail and generating first detection data representative thereof when said suspending means does not suspend one of the pumps, means for detecting the pressure in the fuel in the common rail and generating second detection data representative thereof when said suspending means suspends one of the pumps, means for comparing the first detection data and the second detection data, and means for detecting whether or not at least one of the pumps fails in response to a result of said comparing by the comparing means.

7. The common-rail fuel injection system of claim 1, wherein said detecting means comprises idle detecting means for detecting whether or not the engine is idling, means for, in cases where said idle detecting means detects that the engine is idling, selectively suspending one of the pumps, means for, in cases where said idle detecting means detects that the engine is idling, detecting the pressure in the fuel in the common rail and generating first detection data representative thereof when said suspending means does not suspend one of the pumps, means for, in cases where said idle detecting means detects that the engine is idling, detecting the pressure in the fuel in the common rail and generating second detection data representative thereof when said suspending means suspends one of the pumps, means for comparing the first detection data and the second detection data, and means for detecting whether or not at least one of the pumps fails in response to a result of said comparing by the comparing means.

8. The common-rail fuel injection system of claim 1, wherein said engine comprises a diesel engine.

9. In a common-rail fuel injection system for an engine which comprises a common rail storing fuel, a plurality of pumps supplying fuel to the common rail, means for injecting fuel into the engine from the common rail, and means for feedback-controlling a pressure of the fuel in the common rail, a method comprising the steps of:

detecting whether or not at least one of the pumps fails; and decreasing the pressure of the fuel in the common rail when said detecting step detects that at least one of the pumps fails.

10. A common-rail fuel injection system for an engine, comprising:

a common rail storing fuel;

a plurality of pumps supplying fuel to the common rail;

means for injecting fuel into the engine from the common rail;

means for feedback-controlling a pressure of the fuel in the common rail;

means for detecting whether or not at least one of the pumps fails; and means for decreasing a fuel supply quantity loaded on the pumps when said detecting means detects a pump failure.

11. The common-rail fuel injection system of claim 10, wherein said decreasing means comprises means for decreasing a fuel injecting quantity injected by the injection means to decrease the loaded fuel supply quantity on the pumps.

12. The common-rail fuel injection system of claim 10, further comprising means for maintaining a quantity of fuel injected by the injecting means at a target quantity, and wherein said decreasing means comprises means for decreasing the target quantity.

13. The common-rail fuel injection system of claim 12, wherein said decreasing means comprises means for limiting the target quantity within a range upper bounded by a predetermined guard quantity.

14. The common-rail fuel injection system of claim 12, further comprising means for determining a target common-rail pressure and decreasing the target common-rail pressure according to said decreasing of the target quantity, and wherein said feedback-controlling means comprises means for controlling the pressure of the fuel in the common rail at the target common-rail pressure determined by the determining means.

15. In a common-rail fuel injection system for an engine which comprises a common rail storing fuel, a plurality of pumps supplying fuel to the common rail, means for injecting fuel into the engine from the common rail, and means for feedback-controlling a pressure of the fuel in the common rail, a method comprising the steps of:

detecting whether or not at least one of the pumps fails; and decreasing a fuel supply quantity loaded on the pumps when said detecting step detects that at least one of the pumps has failed.

* * * * *